US008182030B1

(12) United States Patent
Britten

(10) Patent No.: US 8,182,030 B1
(45) Date of Patent: May 22, 2012

(54) CHILD CARRIER LUGGAGE ASSEMBLY

(76) Inventor: Craig M. Britten, Sammamish, WA (US)

( * ) Notice: Subject to any disclaimer, the term of this patent is extended or adjusted under 35 U.S.C. 154(b) by 148 days.

(21) Appl. No.: 12/760,121

(22) Filed: Apr. 14, 2010

(51) Int. Cl.
*A47C 13/00* (2006.01)

(52) U.S. Cl. ..... 297/129; 297/118

(58) Field of Classification Search ..... 297/118, 297/129
See application file for complete search history.

(56) References Cited

U.S. PATENT DOCUMENTS

| | | | | | |
|---|---|---|---|---|---|
| 2,545,336 | A | * | 3/1951 | Binder | 280/650 |
| 2,843,185 | A | * | 7/1958 | Clem et al. | 297/129 X |
| 3,997,213 | A | * | 12/1976 | Smith et al. | 297/118 |
| 4,290,625 | A | * | 9/1981 | Barriere | 297/129 X |
| 4,846,486 | A | * | 7/1989 | Hobson | 280/47.25 |
| 4,955,517 | A | * | 9/1990 | Maresca | 297/129 X |
| 5,016,792 | A | * | 5/1991 | Jay | 297/129 X |
| 5,062,557 | A | * | 11/1991 | Mahvi et al. | 297/129 X |
| 5,230,450 | A | * | 7/1993 | Mahvi et al. | 297/129 X |
| 5,297,708 | A | * | 3/1994 | Carpenter | 297/129 X |
| 5,303,975 | A | * | 4/1994 | Asato | 297/129 |
| 5,318,342 | A | * | 6/1994 | Hale | 297/129 |
| 5,350,215 | A | * | 9/1994 | DeMars | 297/129 X |
| 5,374,073 | A | | 12/1994 | Hung-Hsin | |
| 5,409,291 | A | * | 4/1995 | Lamb et al. | 297/129 |
| 5,499,760 | A | * | 3/1996 | Pielocik | 297/129 X |
| 5,507,508 | A | * | 4/1996 | Liang | 280/37 |
| 5,695,246 | A | * | 12/1997 | Tsai | 297/335 |
| 5,779,112 | A | * | 7/1998 | Krulik | 297/129 X |
| 5,899,467 | A | * | 5/1999 | Henkel | 297/129 X |
| 5,941,352 | A | * | 8/1999 | Lee | 190/11 |
| 5,957,349 | A | * | 9/1999 | Krulik | 297/129 X |
| 5,975,389 | A | * | 11/1999 | Braun et al. | 297/129 X |
| 5,988,657 | A | * | 11/1999 | Henkel | 297/129 X |
| 6,048,023 | A | * | 4/2000 | Lampton | 297/129 |
| 6,145,716 | A | * | 11/2000 | Caicedo | 297/129 X |
| 6,213,265 | B1 | * | 4/2001 | Wang | 190/11 |
| 6,217,113 | B1 | * | 4/2001 | Knatz | 297/118 |
| 6,241,313 | B1 | | 6/2001 | Lenz et al. | |
| D459,883 | S | | 7/2002 | Worrell et al. | |
| 6,471,019 | B1 | * | 10/2002 | Miller | 190/11 |
| 6,547,324 | B1 | * | 4/2003 | Ammann, Jr. | 297/129 |
| 6,644,447 | B2 | * | 11/2003 | Pohl | 190/8 |
| 6,932,427 | B2 | | 8/2005 | Tamura | |
| 6,986,445 | B1 | * | 1/2006 | Stockman | 297/129 X |
| 6,997,507 | B2 | * | 2/2006 | Rhee | 297/129 |
| 7,040,635 | B1 | * | 5/2006 | Remole | 280/47.18 |
| 7,097,017 | B1 | * | 8/2006 | LaCrosse et al. | 190/8 |
| 7,213,692 | B2 | * | 5/2007 | Wang et al. | 190/8 |
| 7,350,857 | B2 | * | 4/2008 | Bishop | 297/129 |
| 7,354,049 | B2 | | 4/2008 | Schmidt | |
| 7,523,949 | B1 | * | 4/2009 | Galfin | 297/129 X |
| 7,757,912 | B1 | * | 7/2010 | Fabro | 297/129 X |
| 7,857,328 | B1 | * | 12/2010 | Boss | 280/47.25 |
| 7,987,955 | B2 | * | 8/2011 | Puchalski | 190/18 A |
| 2004/0021353 | A1 | | 2/2004 | Lozano et al. | |
| 2005/0110231 | A1 | | 5/2005 | Brown | |
| 2007/0089952 | A1 | | 4/2007 | Herbst et al. | |
| 2008/0179358 | A1 | * | 7/2008 | Redzisz et al. | 297/129 X |
| 2009/0159385 | A1 | | 6/2009 | Poissant et al. | |

* cited by examiner

*Primary Examiner* — Rodney B White

(57) ABSTRACT

A child carrier luggage assembly for facilitating transportation of a child while traveling includes a wheeled luggage bag and a seat assembly coupled to the front of the luggage bag. The seat assembly includes a seat member hingedly coupled to the front of the luggage bag and a strap assembly coupled between the seat member and the front of the luggage bag. A pedestal member is hingedly coupled to the seat member such that the pedestal member extends outwardly from the seat member to support the seat member when the seat member is in an open position. Alternatively, the seat assembly is coupled to a panel attached to the wheeled luggage bag using a harness assembly.

18 Claims, 7 Drawing Sheets

CHILD CARRIER LUGGAGE ASSEMBLY

BACKGROUND OF THE DISCLOSURE

Field of the Disclosure

The disclosure relates to luggage bags and more particularly pertains to a new luggage bag for facilitating transportation of a child while traveling.

SUMMARY OF THE DISCLOSURE

An embodiment of the disclosure meets the needs presented above by generally comprising a wheeled luggage bag and a seat assembly coupled to the front of the luggage bag. The seat assembly includes a seat member hingedly coupled to the front of the luggage bag and a strap assembly coupled between the seat member and the front of the luggage bag. A pedestal member is hingedly coupled to the seat member such that the pedestal member extends outwardly from the seat member to support the seat member when the seat member is in an open position. Alternatively, the seat assembly is coupled to a panel attached to the wheeled luggage bag using a harness assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
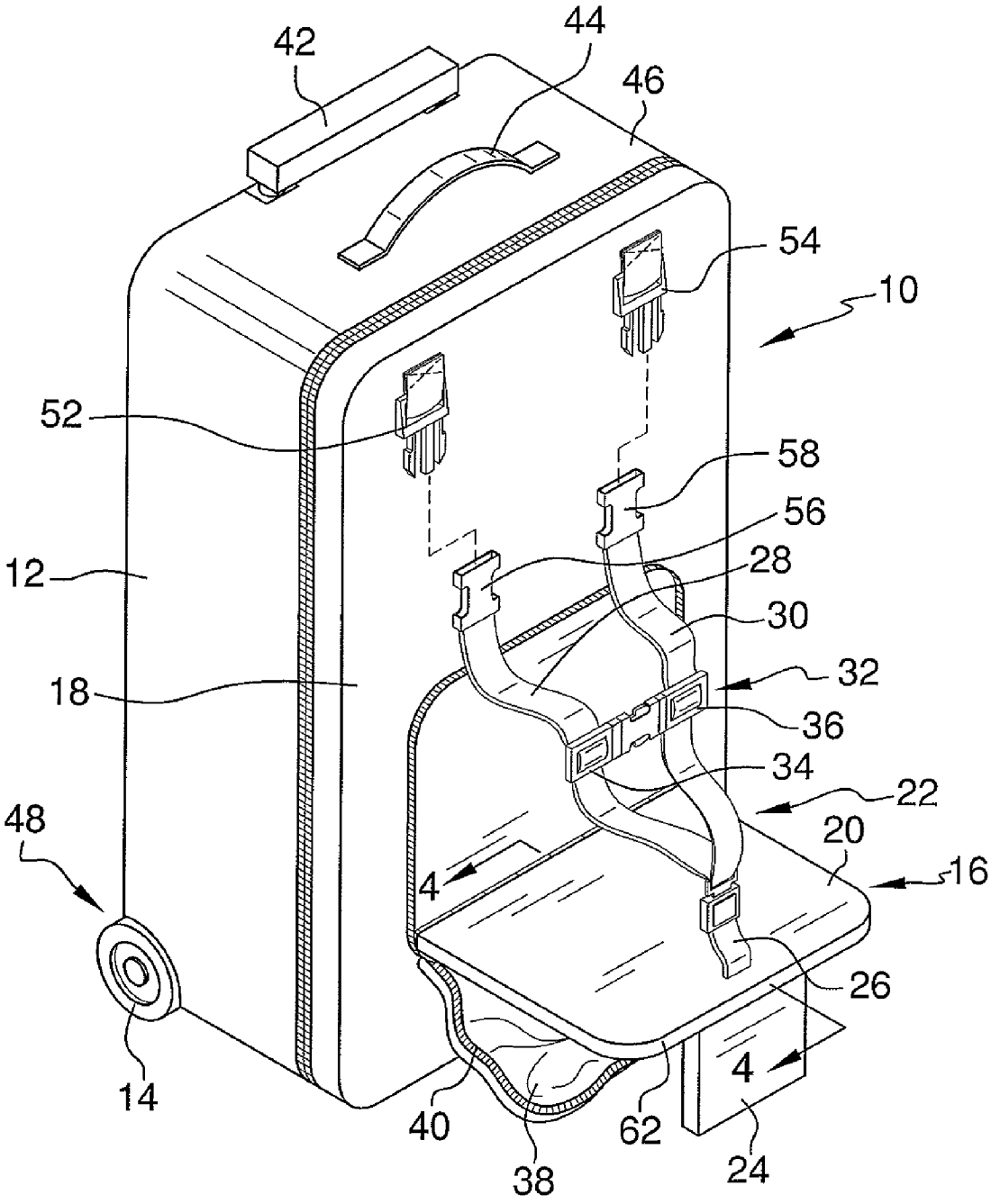
FIG. 1 is a front top side perspective view of a child carrier luggage assembly according to an embodiment of the disclosure.
Figure 2:
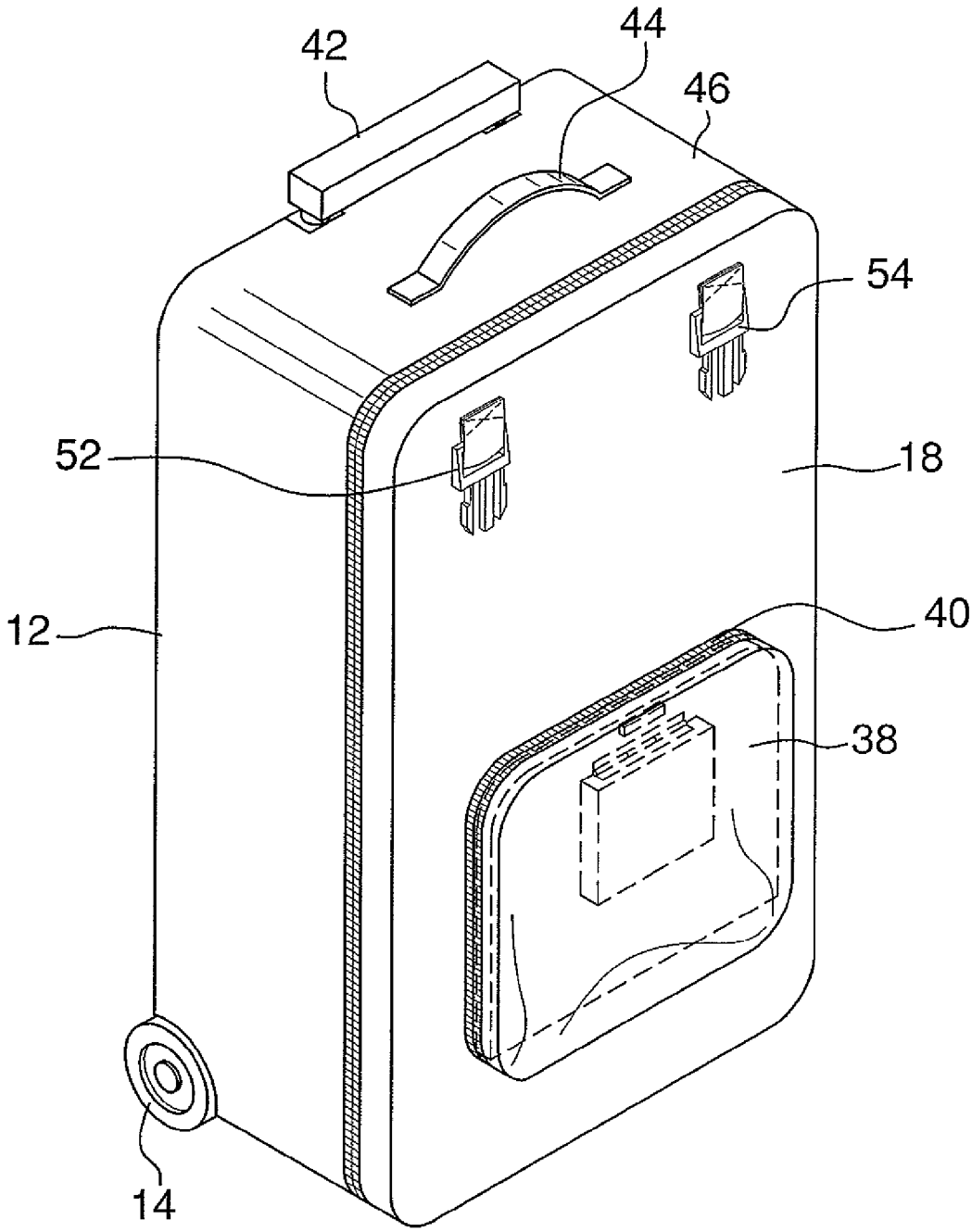
FIG. 2 is a front top side perspective view of an embodiment of the disclosure in a closed position.
Figure 3:
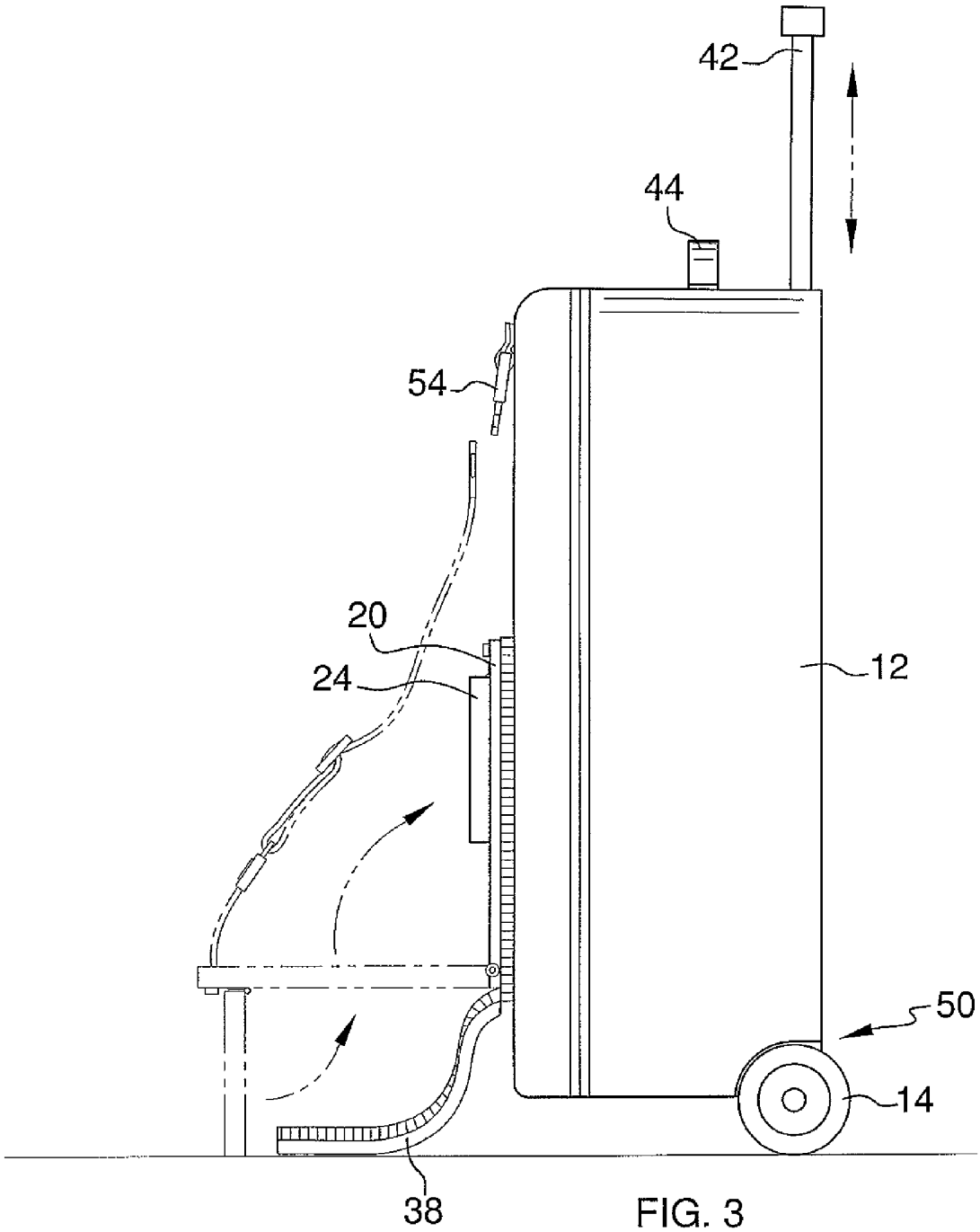
FIG. 3 is a side view of an embodiment of the disclosure.
Figure 4:
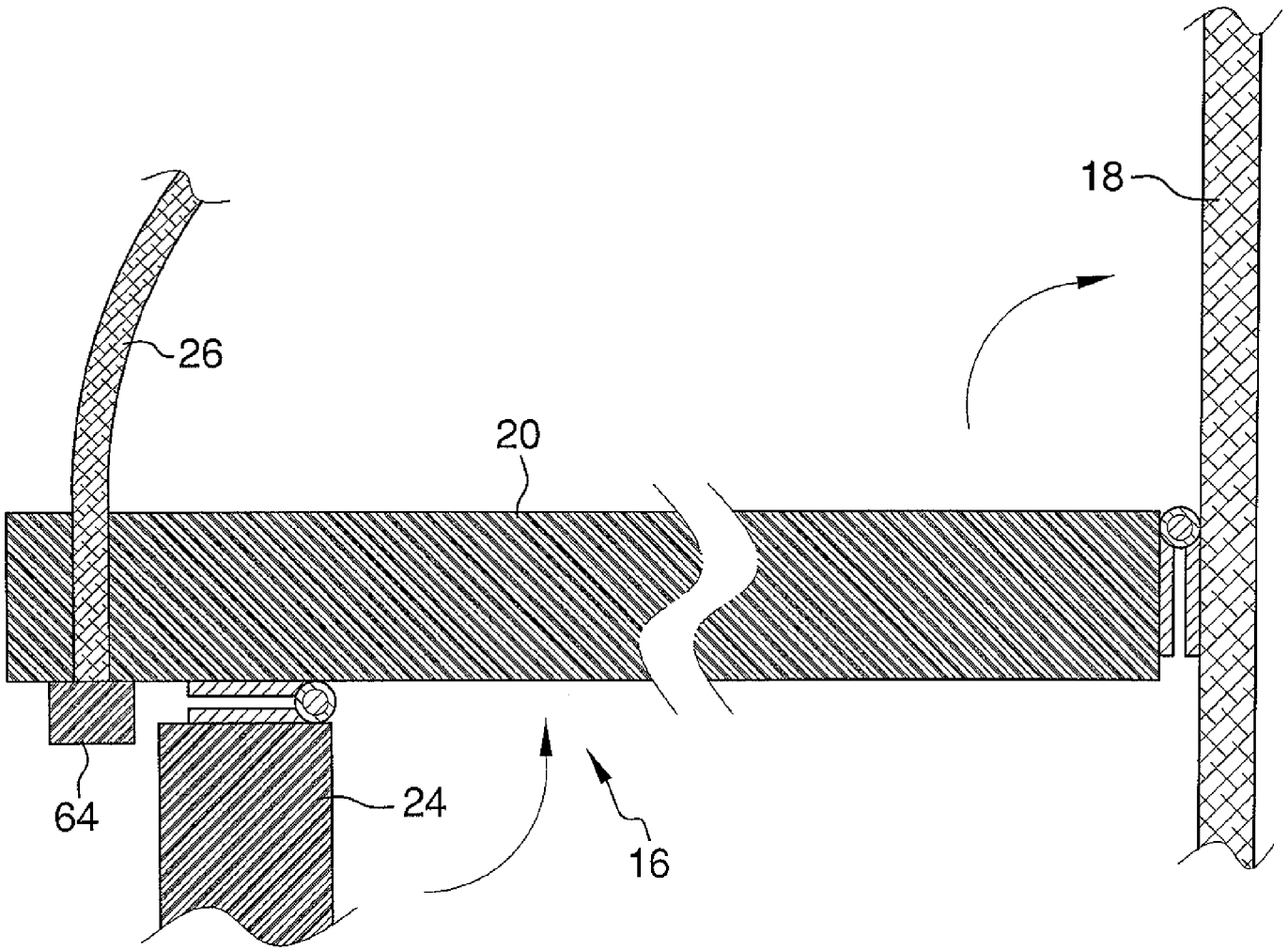
FIG. 4 is a cross-sectional view of an embodiment of the disclosure taken along line 4-4 of FIG. 1.
Figure 5:
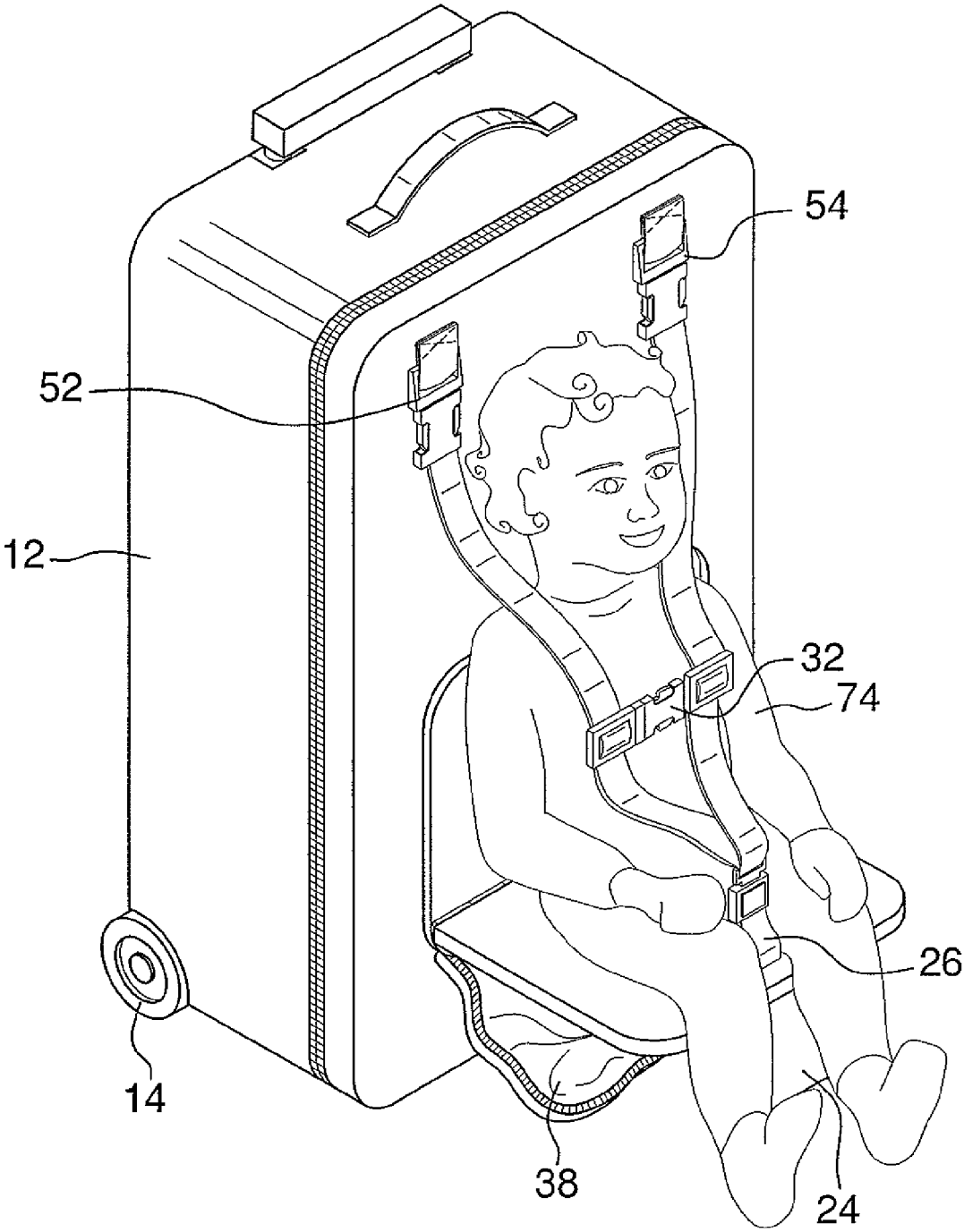
FIG. 5 is a front top side perspective view of an embodiment of the disclosure in use.
Figure 6:
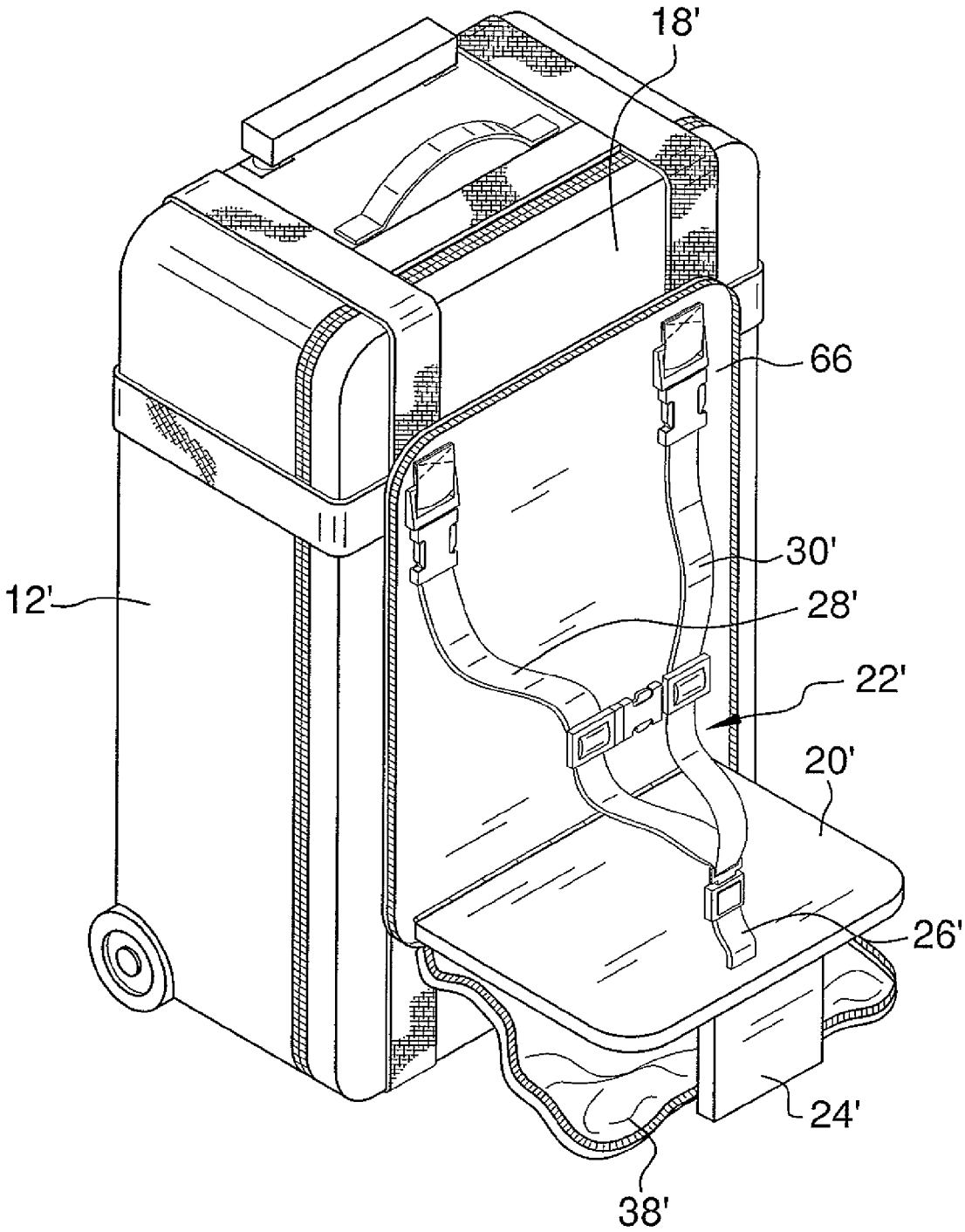
FIG. 6 is a front top side perspective view of an alternate embodiment of the disclosure.
Figure 7:
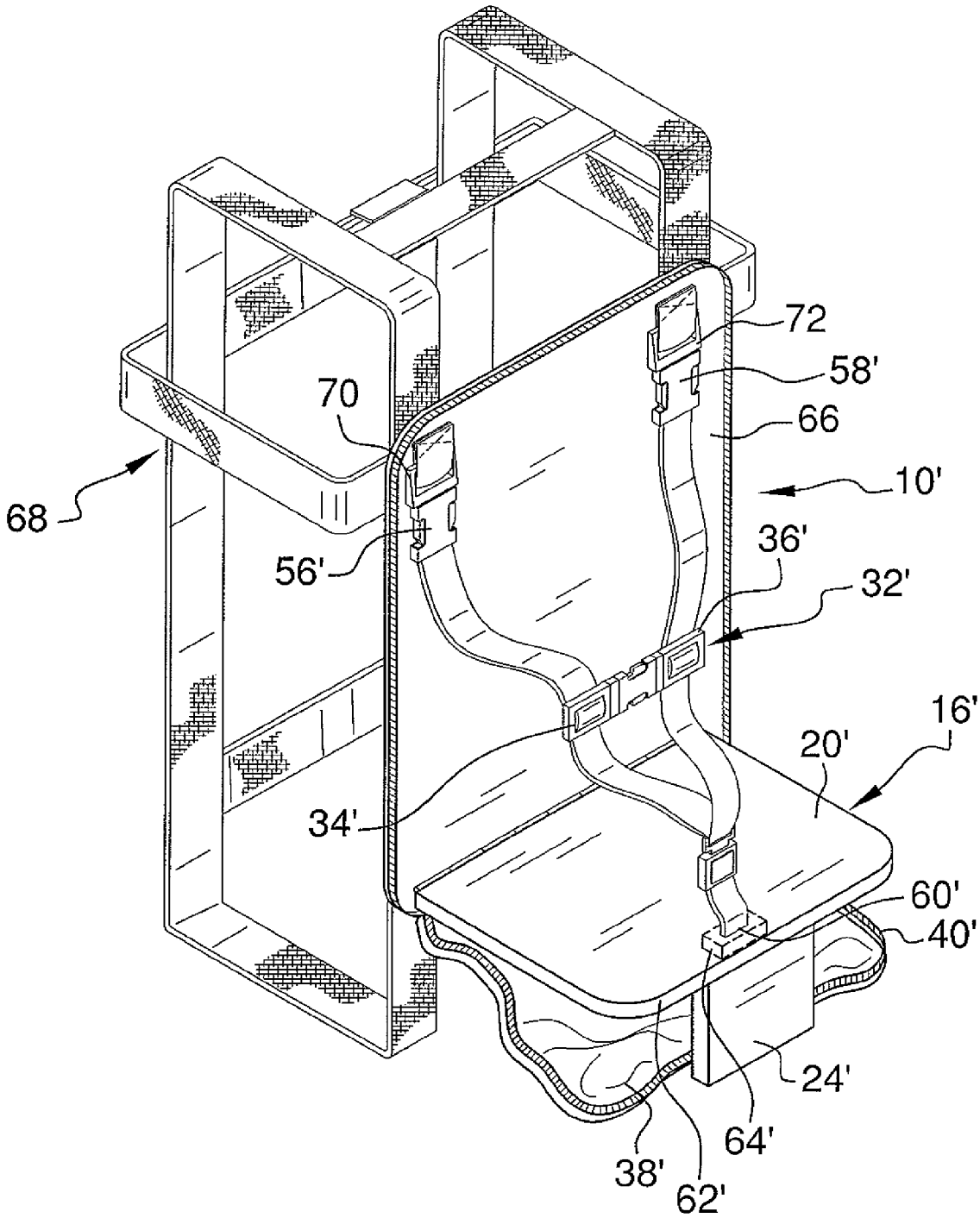
FIG. 7 is a front top side perspective view of an embodiment of the disclosure.

With reference now to the drawings, and in particular to FIGS. 1 through 7 thereof, a new luggage bag embodying the principles and concepts of an embodiment of the disclosure and generally designated by the reference numeral 10 will be described.

As best illustrated in FIGS. 1 through 7, the child carrier luggage assembly 10 generally comprises a luggage bag 12, wheels 14 coupled to the luggage bag 12, and a seat assembly

16 coupled to a front 18 of the luggage bag 12. The seat assembly 16 includes a seat member 20 hingedly coupled to the front 18 of the luggage bag 12 and a strap assembly 22 coupled between the seat member 20 and the front 18 of the luggage bag 12. A pedestal member 24 is hingedly coupled to the seat member 20 such that the pedestal member 24 extends outwardly from the seat member 20 to support the seat member 20 when the seat member 20 is in an open position.

The strap assembly 22 includes a base portion 26, a first shoulder portion 28 extending from the base portion 26, and a second shoulder portion 30 extending from the base portion 26. The first shoulder portion 28 and the second shoulder portion 30 are releasably coupled to the luggage bag 12. The strap assembly 22 further includes a chest buckling assembly 32 having a first buckle portion 34 attached to the first shoulder portion 28 and a complimentary second buckle portion 36 attached to the second should portion 30 such that the first buckle portion 34 is securable to the second buckle portion 36.

A flap member 38 is coupled to the front 18 of the luggage bag 12 proximate the seat member 20 such that the flap member 38 is positionable to cover the seat member 20 and the pedestal member 24 when the seat member 20 and the pedestal member 24 are in a closed position. A closure mechanism 40 is coupled to the luggage bag 12 for securing the flap member 38 over the seat member 20 and the pedestal member 24.

A telescoping handle 42 is coupled to the luggage bag 12. A fixed handle 44 is coupled to a top 46 of the luggage bag 12. The wheels 14 are positioned at distal bottom corners 48,50 of the luggage bag 12 relative to the seat member 20.

A first luggage bag buckle member 52 is coupled to the front 18 of the luggage bag 12. A second luggage bag buckle member 54 is coupled to the front 18 of the luggage bag 12. The first shoulder portion 28 has a first shoulder buckle member 56 couplable to the first luggage bag buckle member 52 for releasably coupling the first shoulder portion 28 to the luggage bag 12. The second shoulder portion 30 has a second shoulder buckle member 58 couplable to the second luggage bag buckle member 54 for releasably coupling the second shoulder portion 30 to the luggage bag 12.

A slot 60 is positioned in the seat member 20 proximate a distal edge 62 relative to the luggage bag 12. The base portion 26 of the strap assembly 22 extends through the slot 60 in the seat member 20. A stopping member 64 is coupled to the base portion 26 for preventing the base portion 26 from passing completely through the slot 60 in the seat member 20.

In an alternate embodiment, the child carrier 10' for attachment to wheeled luggage bag 12' having a front 18'. The child carrier 10' comprises a panel member 66 designed for positioning adjacent to the front 18' of the wheeled luggage bag 12'. A harness assembly 68 is coupled to the panel member 66 such that the panel member 66 is designed for being secured to the front 18' of the wheeled luggage bag 12'. A seat assembly 16' is coupled to the panel member 66. The seat assembly 16' includes a seat member 20' hingedly coupled to the panel member 66 and a strap assembly 22' coupled between the seat member 20' and the panel member 66. A pedestal member 24' is hingedly coupled to the seat member 20' such that the pedestal member 24' extends outwardly from the seat member 20' to support the seat member 20' when the seat member 20' is in an open position. The strap assembly 22' includes a base portion 26', a first shoulder portion 28' extending from the base portion 26', and a second shoulder portion 30' extending from the base portion 26'. The first shoulder portion 28' and the second shoulder portion 30' are releasably coupled to the panel member 66. The strap assembly 22' further includes a chest buckling assembly 32' having a first buckle portion 34' attached to the first shoulder portion 28' and a complimentary second buckle portion 36' attached to the second shoulder portion 30' such that the first buckle portion 34' is securable to the second buckle portion 36'.

A flap member 38' is coupled to the panel member 66 proximate the seat member 20' such that the flap member 38' is positionable to cover the seat member 20' and the pedestal member 24' when the seat member 20' and the pedestal member 24' are in a closed position. A closure mechanism 40' is coupled to the panel member 66 for securing the flap member 38' over the seat member 20' and the pedestal member 24'.

A first panel buckle member 70 is coupled to the panel member 66. A second panel buckle member 72 is coupled to the panel member 66. The first shoulder portion 28' has a first shoulder buckle member 56' couplable to the first panel buckle member 70 for releasably coupling the first shoulder portion 28' to the panel member 66. The second shoulder portion 30' has a second shoulder buckle member 58' couplable to the second panel buckle member 72 for releasably coupling the second shoulder portion 30' to the panel member 66.

A slot 60' is positioned in the seat member 20' proximate a distal edge 62' relative to the panel member 66. The base portion 26' of the strap assembly 22' extends through the slot 60' in the seat member 20'. A stopping member 64' is coupled to the base portion 26' for preventing the base portion 26' from passing completely through the slot 60' in the seat member 20'.

In use, while traveling seat member 20 may be exposed by releasing the closure mechanism 40 and pivoting the seat member 20 and pedestal 24 into an open position. A child 74 can sit on the seat member 20 and strapped to the seat member 20 using the strap assembly 22. The telescoping handle 42 can be extended and the luggage bag 12 pulled on the wheels 14. Using the alternate embodiment, the panel member 66 is strapped to a luggage bag 12' using the harness assembly 68. Once secured to the luggage bag 12' the child carrier 10' is used similarly to the first embodiment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A child carrier luggage assembly comprising:

a luggage bag;

wheels coupled to said luggage bag;

a seat assembly coupled to a front of said luggage bag, said seat assembly including a seat member hingedly coupled to said front of said luggage bag and a strap assembly coupled between said seat member and said front of said luggage bag; and a pedestal member hingedly coupled to said seat member such that said pedestal member extends outwardly from said seat member to support said seat member when said seat member is in an open position;

wherein said strap assembly includes a base portion, a first shoulder portion extending from said base portion, and a second shoulder portion extending from said base portion, said first shoulder portion and said second shoulder portion being releasably coupled to said luggage bag;

a first luggage bag buckle member coupled to said front of said luggage bag;

a second luggage bag buckle member coupled to said front of said luggage bag;

said first shoulder portion having a first shoulder buckle member couplable to said first luggage bag buckle member for releasably coupling said first shoulder portion to said luggage bag; and said second shoulder portion having a second shoulder buckle member couplable to said second luggage bag buckle member for releasably coupling said second shoulder portion to said luggage bag.

2. The child carrier luggage assembly of claim 1, wherein said strap assembly further includes a chest buckling assembly having a first buckle portion attached to said first shoulder portion and a complimentary second buckle portion attached to said second should portions such that said first buckle portion is securable to said second buckle portion.

3. The child carrier luggage assembly of claim 1, further comprising:

a flap member coupled to said front of said luggage bag proximate said seat member such that said flap member is positionable to cover said seat member and said pedestal member when said seat member and said pedestal member are in a closed position; and a closure mechanism coupled to said luggage bag for securing said flap member over said seat member and said pedestal member.

4. The child carrier luggage assembly of claim 1, further including a telescoping handle coupled to said luggage bag.

5. The child carrier luggage assembly of claim 1, further including a fixed handle coupled to a top of said luggage bag.

6. The child carrier luggage assembly of claim 1, wherein said wheels are positioned at distal bottom corner of said luggage bag relative to said seat member.

7. The child carrier luggage assembly of claim 1, further comprising:

a slot positioned in said seat member proximate a distal edge relative to said luggage bag;

wherein said base portion of said strap assembly extends through said slot in said seat member; and a stopping member coupled to said base portion for preventing said base portion from passing completely through said slot in said seat member.

8. The child carrier luggage assembly of claim 7, further including a telescoping handle coupled to said luggage bag.

9. The child carrier luggage assembly of claim 7, further including a fixed handle coupled to a top of said luggage bag.

10. The child carrier luggage assembly of claim 7, wherein said wheels are positioned at distal bottom corner of said luggage bag relative to said seat member.

11. The assembly of claim 1, further comprising:

wherein said strap assembly further includes a chest buckling assembly having a first buckle portion attached to said first shoulder portion and a complimentary second buckle portion attached to said second shoulder portion such that said first buckle portion is securable to said second buckle portion;

a flap member coupled to said front of said luggage bag proximate said seat member such that said flap member is positionable to cover said seat member and said pedestal member when said seat member and said pedestal member are in a closed position;

a closure mechanism coupled to said luggage bag for securing said flap member over said seat member and said pedestal member;

a telescoping handle coupled to said luggage bag;

a fixed handle coupled to a top of said luggage bag;

wherein said wheels are positioned at distal bottom corner of said luggage bag relative to said seat member;

a slot positioned in said seat member proximate a distal edge relative to said luggage bag;

wherein said base portion of said strap assembly extends through said slot in said seat member; and a stopping member coupled to said base portion for preventing said base portion from passing completely through said slot in said seat member.

12. A child carrier for attachment to wheeled luggage bag having a front, said child carrier comprising:

a panel member adapted for positioning adjacent to the front of the wheeled luggage bag;

a harness assembly coupled to said panel member such that said panel member is adapted for being secured to the front of the wheeled luggage bag;

a seat assembly coupled to said panel member, said seat assembly including a seat member hingedly coupled to said panel member and a strap assembly coupled between said seat member and said panel member; and a pedestal member hingedly coupled to said seat member such that said pedestal member extends outwardly from said seat member to support said seat member when said seat member is in an open position;

wherein said strap assembly includes a base portion, a first shoulder portion extending from said base portion, and a second shoulder portion extending from said base portion, said first shoulder portion and said second shoulder portion being releasably coupled to said panel member;

a first panel buckle member coupled to said panel member;

a second panel buckle member coupled to said panel member;

said first shoulder portion having a first shoulder buckle member couplable to said first panel buckle member for releasably coupling said first shoulder portion to said panel member; and said second shoulder portion having a second shoulder buckle member couplable to said second panel buckle member for releasably coupling said second shoulder portion to said panel member.

13. The child carrier of claim 12, wherein said strap assembly further includes a chest buckling assembly having a first buckle portion attached to said first shoulder portion and a complimentary second buckle portion attached to said second shoulder portions such that said first buckle portion is securable to said second buckle portion.

14. The child carrier luggage assembly of claim 12, further comprising:

a flap member coupled to said panel member proximate said seat member such that said flap member is positionable to cover said seat member and said pedestal member when said seat member and said pedestal member are in a closed position; and a closure mechanism coupled to said panel member for securing said flap member over said seat member and said pedestal member.

15. A child carrier for attachment to wheeled luggage bag having a front, said child carrier comprising:

a panel member adapted for positioning adjacent to the front of the wheeled luggage bag;

a harness assembly coupled to said panel member such that said panel member is adapted for being secured to the front of the wheeled luggage bag;

a seat assembly coupled to said panel member, said seat assembly including a seat member hingedly coupled to said panel member and a strap assembly coupled between said seat member and said panel member;

a pedestal member hingedly coupled to said seat member such that said pedestal member extends outwardly from said seat member to support said seat member when said seat member is in an open position;

wherein said strap assembly includes a base portion, a first shoulder portion extending from said base portion, and a second shoulder portion extending from said base portion, said first shoulder portion and said second shoulder portion being releasably coupled to said panel member;

a first panel buckle member coupled to said panel member;

a slot positioned in said seat member proximate a distal edge relative to said panel member;

wherein said base portion of said strap assembly extends through said slot in said seat member; and a stopping member coupled to said base portion for preventing said base portion from passing completely through said slot in said seat member.

16. The child carrier of claim 15, wherein said strap assembly further includes a chest buckling assembly having a first buckle portion attached to said first shoulder portion and a complimentary second buckle portion attached to said second shoulder portion such that said first buckle portion is securable to said second buckle portion.

17. The child carrier luggage assembly of claim 15, further comprising:

a flap member coupled to said panel member proximate said seat member such that said flap member is positionable to cover said seat member and said pedestal member when said seat member and said pedestal member are in a closed position; and a closure mechanism coupled to said panel member for securing said flap member over said seat member and said pedestal member.

18. The child carrier of claim 12, further comprising:

wherein said strap assembly further includes a chest buckling assembly having a first buckle portion attached to said first shoulder portion and a complimentary second buckle portion attached to said second shoulder portion such that said first buckle portion is securable to said second buckle portion;

a flap member coupled to said panel member proximate said seat member such that said flap member is positionable to cover said seat member and said pedestal member when said seat member and said pedestal member are in a closed position;

a closure mechanism coupled to said panel member for securing said flap member over said seat member and said pedestal member;

a slot positioned in said seat member proximate a distal edge relative to said panel member;

wherein said base portion of said strap assembly extends through said slot in said seat member; and a stopping member coupled to said base portion for preventing said base portion from passing completely through said slot in said seat member.

* * * * *